US005775964A

United States Patent [19]

Clark

[11] Patent Number: 5,775,964

[45] Date of Patent: Jul. 7, 1998

[54] FLUID MIXER CONDUIT

[76] Inventor: Scott R. Clark, 2021 Umbrella Tree Dr., Edgewater, Fla. 32141

[21] Appl. No.: 657,788

[22] Filed: May 31, 1996

[51] Int. Cl.[6] ..... B63H 21/10

[52] U.S. Cl. ..... 440/88

[58] Field of Search ..... 440/88, 89, 900, 440/113; 134/166 R, 167 R, 168 R, 172; 165/95

[56] References Cited

U.S. PATENT DOCUMENTS

| | | | |
|---|---|---|---|
| 3,550,612 | 12/1970 | Maxon | 137/112 |
| 4,619,618 | 10/1986 | Patti | 440/88 |
| 4,677,929 | 7/1987 | Harris | 440/88 |
| 4,789,367 | 12/1988 | Fulks | 440/88 |
| 4,919,800 | 4/1990 | Vinoski | 219/94 |
| 5,004,042 | 4/1991 | McMorries, IV et al. | 440/88 |
| 5,295,880 | 3/1994 | Parker | 440/88 |
| 5,350,329 | 9/1994 | Haman | 440/88 |
| 5,362,265 | 11/1994 | Gervais | 440/88 |
| 5,393,252 | 2/1995 | Brogdon | 440/88 |
| 5,397,256 | 3/1995 | Bidwell | 440/88 |
| 5,482,483 | 1/1996 | Rice | 440/88 |

*Primary Examiner*—Stephen Avila
*Attorney, Agent, or Firm*—Edward M. Livingston, Esq.

[57] ABSTRACT

A fluid mixer conduit having a delivery tube (1) with an input end (2), an output end (3) and a flow restriction (4, 15) designedly upstream fluidly from the output end. An input tube (5) extends outwardly from the delivery tube designedly downstream fluidly from the input end of the delivery tube. The input tube converges back into the delivery tube at a mixture entry (7) intermediate the flow restriction and the output end of the delivery tube. Attachable to the input tube is at least one ingredient entry (8, 12) through which fluid can be directed into the input tube for mixture with fluid in the delivery tube at the mixture entry. A flow-control valve (9) can be provided in an upstream portion of the input tube for regulating rate of flow of fluid in the input tube in proportion to rate of flow of fluid in the delivery tube. A check valve (10) can be provided in a downstream portion of the input tube to prevent back-flow of fluid from the delivery tube. The flow restriction can be a venturi throat (15). The input end and the output end of the delivery tube can have design tube connections (11) for connection of such conduits as garden hoses, chemical pipes and conduits related to other design uses.

20 Claims, 2 Drawing Sheets

FLUID MIXER CONDUIT

BACKGROUND OF THE INVENTION

This invention relates to tubular conduits in which a plurality of fluids are mixed prior to use for such applications as cleaning, flushing, chemical processing and fluid treating with fluids mixed in the tubular conduit.

There are no known fluid-mixer conduits having a capacity to mix a plurality of fluids or one or more fluids with one or more nonliquid substances continuously, reliably, controllably, conveniently and adaptationally in a manner taught by this invention. Examples of different but related prior art is described in the following patent documents: U.S. Pat. No. 5,362,265, issued to Gervais on Nov. 8, 1994; U.S. Pat. No. 5,295,880, issued to Parker on Mar. 22, 1994; and U.S. Pat. No. 4,619,618, issued to Patti on Oct. 28, 1986.

A fluid mixing conduit of the present invention would be particularly useful for flushing marine outboard or inboard/outboard engine cooling systems. Currently, before and especially after a boat is used, the cooling system must be flushed to remove contaminants and salt water. Generally, the latter is accomplished by connecting a hose to a pair of ears which clamp around the cooling water inlet parts and fresh water under pressure is rune through the hose. Unfortunately, the water does not remove all contaminants and rust and corrosion build up in the cooling system, thereby decreasing engine efficiency and use life.

It has been found that mixing a rust and corrosion inhibiting fluid, such as mineral oil, W-D 40, transmission fluid or similar oil, with the flushing water will coat the surfaces of the cooling system and inhibit rust and corrosion.

Thus, a need exists for a device like the present invention that can be attached between the hose and the engine which can mix such a rust and corrosion-inhibiting fluid with the flushing water.

No other prior art is known or believed to be sufficiently similar for comparison.

SUMMARY OF THE INVENTION

In light of a vast need for mixing fluids and other substances in a conduit en route to an end use or application, objects of this invention are to provide a fluid-mixer conduit which:

- Mixes a plurality of fluids in a conduit at a design position relative to an end use or application of mixed fluids;
- Can be structured for mixing a design plurality of fluids;
- Can mix nonliquid substances with liquids;
- Is conveniently adjustable in ratio of fluids mixed;
- Has variable flow rate that is adjustable conveniently;
- Is conveniently hand-held or structured to be positioned wherever needed;
- Is adaptable to mixing a wide range of types of liquid and nonliquid substances; and
- Has long use life at low cost with minimal maintenance.

This invention accomplishes these and other objectives with a fluid-mixer conduit having a delivery tube with an input end, an output end and a flow restriction designedly upstream fluidly from the output end. An input tube extends outwardly from the delivery tube designedly downstream fluidly from the input end of the delivery tube. The input tube converges back into the delivery tube at a mixture entry intermediate the flow restriction and the output end of the delivery tube. Attachable to the input tube is at least one ingredient entry through which fluid can be directed into the input tube for mixture with fluid in the delivery tube at the mixture entry. An input valve can be provided in an upstream portion of the input tube for regulating rate of flow of fluid in the input tube in proportion to rate of flow of fluid in the delivery tube. A check valve can be provided in a downstream portion of the input tube to prevent back-flow of fluid from the delivery tube. The flow restriction can be a venturi nozzle. The input end and the output end of the delivery tube can have design tube connections for connection of such conduits as garden hoses, chemical pipes and conduits related to other design uses.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are described briefly as follows:

DESCRIPTION OF PREFERRED EMBODIMENT

Figure 1:
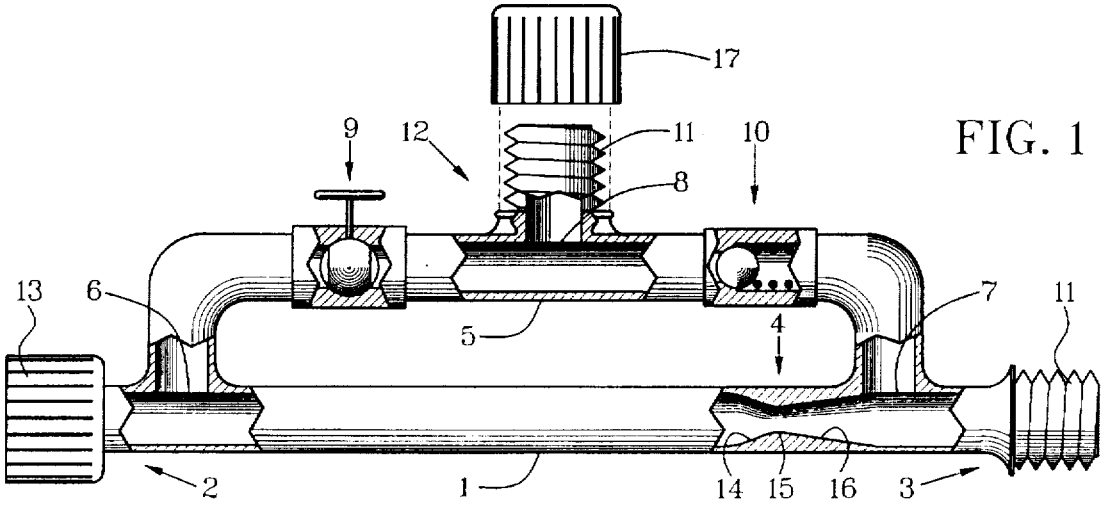
FIG. 1 is a partially cutaway side view of a fluid-mixer conduit having a single ingredient entry, a regulatable flow-control valve and a check valve in an input tube.
Figure 2:
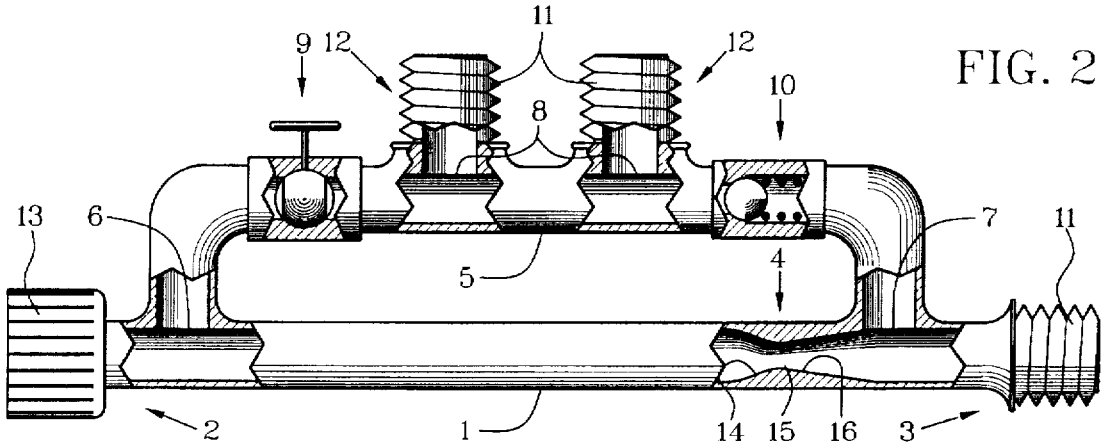
FIG. 2 is the FIG. 1 illustration with a plurality of ingredient entries.

Reference is made first to FIGS. 1–2. A delivery tube 1 has an input end 2 and an output end 3. A flow restriction 4 is positioned designedly upstream for the output end 3 in an internal periphery of the delivery tube 1. An input tube 5 is extended outwardly from the delivery tube 1 at a divergence exit 6 that is designedly downstream from the input end 2 of the delivery tube 1. The input tube 5 converges back into the delivery tube 1 at a mixture entry 7 that is intermediate the flow restriction 4 and the output end 3 of the delivery tube 1. At least one ingredient entry 8 is positioned in fluid communication with the input tube 5 intermediate the divergence exit 6 and the mixture entry 7. A regulatable flow-control valve 9 can be positioned fluidly upstream from an ingredient entry 8 in the input tube 5. Also, a check valve 10 can be positioned fluidly downstream from an ingredient entry 8 in the input tube 5. A single ingredient entry 8 as depicted in FIG. 1 or a plurality of ingredient entries 8 as depicted in FIG. 2 can be employed.

Figure 3:
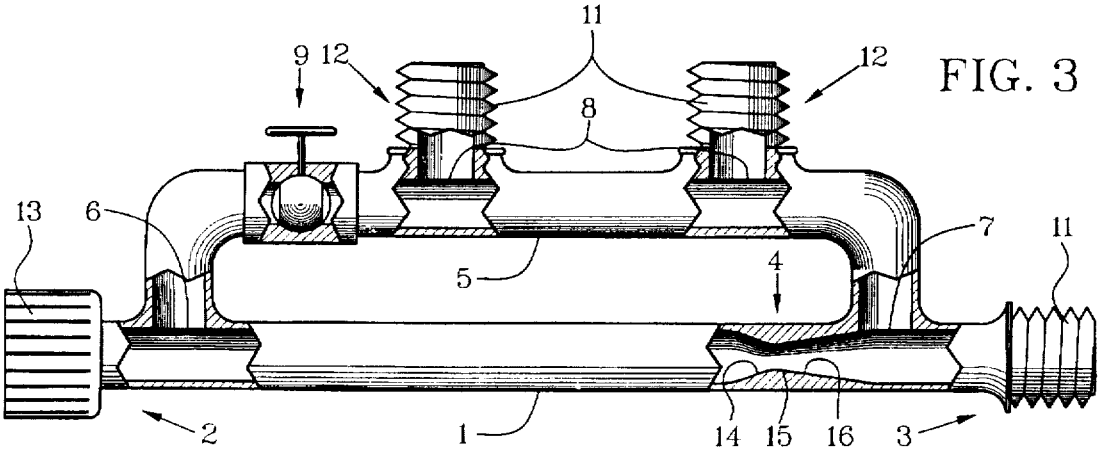
FIG. 3 is the FIG. 2 illustration without a check valve and with the ingredient entries separated for a handle effect.
Figure 4:
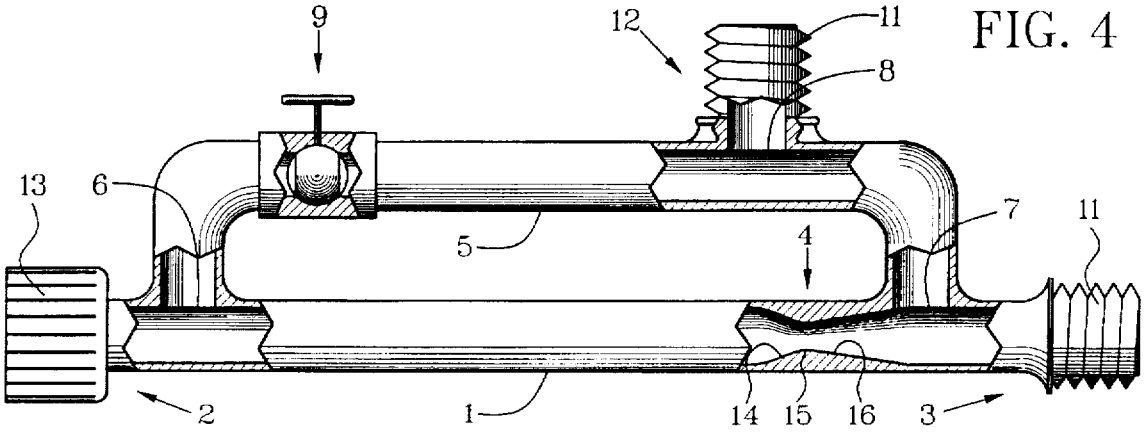
FIG. 4 is the FIG. 3 illustration with a single ingredient entry.

Referring to FIGS. 3–4, the check valve 10 described in relation to FIGS. 1–2 can be omitted for use with either a plurality of ingredient entries 8 as depicted in FIG. 3 or a single ingredient entry 8 as depicted in FIG. 4. Separation of the ingredient entries 8 as in FIG. 3 or separation of an ingredient entry 8 from the flow-control valve 9 as in FIG. 4 can provide a hand-held handle section of the input tube 5 for particular sizes and applications of this fluid-mixer conduit.

Figure 5:
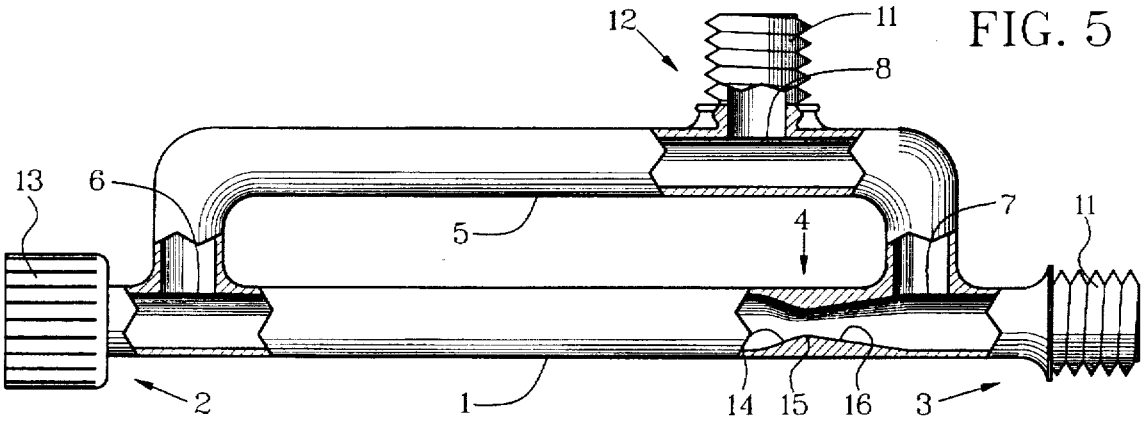
FIG. 5 is a partially cutaway side view of a fluid-mixer conduit having a single ingredient entry and not having either a regulatable flow-control valve or a check valve in an input tube.
Figure 6:
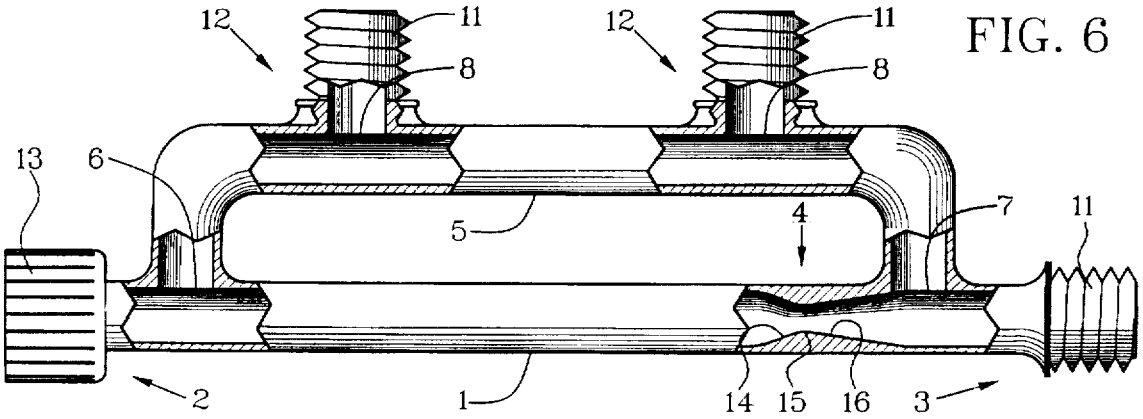
FIG. 6 is the FIG. 5 illustration with a plurality of ingredient entries.

Referring to FIGS. 5–6, the flow-control valve 9 described in relation to FIGS. 1–4 also can be omitted for some applications. A single ingredient entry 8 can be positioned at an end of the input tube 5 as illustrated in FIG. 5 or a plurality of ingredient entries 8 can be separated as illustrated in FIG. 6 for a handle effect on the input tube 5.

Referring to FIGS. 1–6, a threaded connection 11 that is externally threaded can be provided on output ends 3 of the delivery tube 1 and on an ingredient attachment 12 at ingredient entries 8. An internally threaded connection 13 can be provided on the input end 2 of the delivery tube 1. Threading can be sized, shaped and structured for tubular connections to ends of the delivery tube 1 and for either tubular or container connections to the input tube 5 at the ingredient entries 8.

The flow restriction 4 can be a simple baffle but is preferably a venturi having a convergent section 14, a venturi throat 15 and a divergent section 16. Design positioning of the mixture entry 7 is proximate a terminal end of the divergent section 16 of a venturi type of flow restriction 4 where a suction effect exists for some use conditions. The suction effect aids in preventing back flow which would require use of the check valve 10.

For some uses with low-volume flow of mixture ingredients, the input tube 5 can be a reservoir. If the input tube 1 is a reservoir, it can be closed by a screw-on cap 17 that is represented also to be a threaded connector for a container or a hose for high-volume flow or for long duration of flow of mixture ingredients.

For some dedicated uses of this fluid-mixer conduit, neither the flow-control valve 9 nor the check valve 10 are required. For more general-purpose uses, however, both the flow-control valve 9 and the check valve 10 are advantageous for a wider variety of use conditions. The flow-control valve 9 is more useable without the check valve 10 than is the check valve 10 without the flow-control valve 9.

A primary use intended for this fluid-mixer conduit is for flushing boat engines with a container of liquid or powdered soap and/or a rust inhibitor attached to ingredient attachments 12.

A new and useful fluid-mixer conduit having been described, all such modifications, adaptations, substitutions of equivalents, combinations of parts, pluralities of parts, applications and forms thereof as described by the following claims are included in this invention.

Having thus described my invention, I claim:

1. A fluid-mixer conduit comprising:

a delivery tube having an input end and an output end;

a flow restriction in an internal periphery of the delivery tube at a position designedly upstream from the output end of the delivery tube;

an input tube which extends outwardly from the delivery tube at a divergence exit designedly downstream fluidly from the input end of the delivery tube and which converges back into the delivery tube at a mixture entry intermediate the flow restriction and the output end of the delivery tube;

at least one ingredient entry in fluid communication with the input tube intermediate the divergence exit and the mixture entry.

2. A fluid-mixer conduit as described in claim 1 and further comprising:

a regulatable flow-control valve fluidly upstream from an ingredient entry in the input tube.

3. A fluid-mixer conduit as described in claim 1 and further comprising:

a check valve fluidly downstream from an ingredient entry in the input tube.

4. A fluid-mixer conduit as described in claim 3 and further comprising:

a regulatable flow-control valve fluidly upstream from an ingredient entry in the input tube.

5. A fluid-mixer conduit as described in claim 4 wherein:

the at-least-one ingredient entry is a threaded connection that is sized, shaped and structured for a design size range of ingredient-supply means.

6. A fluid-mixer conduit as described in claim 4 wherein:

the at-least-one ingredient entry is a design plurality of threaded connections that are sized, shaped and structured for design size ranges of ingredient-supply means.

7. A fluid-mixer conduit as described in claim 1 wherein:

the at-least-one ingredient entry is a threaded connection that is sized, shaped and structured for a design size range of ingredient-supply means.

8. A fluid-mixer conduit as described in claim 1 wherein:

the at-least-one ingredient entry is a design plurality of threaded connections that are sized, shaped and structured for design size ranges of ingredient-supply means.

9. A fluid-mixer conduit as described in claim 1 wherein:

the input tube is sized, shaped and structured to be hand-held as a handle for the fluid-mixer conduit.

10. A fluid-mixer conduit as described in claim 5 wherein:

the input tube is sized, shaped and structured to be hand-held as a handle for the fluid-mixer conduit.

11. A fluid-mixer conduit as described in claim 6 wherein:

the input tube is sized, shaped and structured to be hand-held as a handle for the fluid-mixer conduit.

12. A fluid-mixer conduit as described in claim 1 wherein:

the flow restriction is a venturi having an internal periphery with a designedly low angle of venturi divergence that is fluidly downstream from a venturi throat that is fluidly downstream from a venturi convergence of an internal periphery of the delivery tube; and the mixture entry is fluidly downstream from the venturi throat.

13. A fluid-mixer conduit as described in claim 5 wherein:

the flow restriction is a venturi having an internal periphery with a designedly low angle of venturi divergence that is fluidly downstream from a venturi throat that is fluidly downstream from a venturi convergence of an internal periphery of the delivery tube; and the mixture entry is fluidly downstream from the venturi throat.

14. A fluid-mixer conduit as described in claim 6 wherein:

the flow restriction is a venturi having an internal periphery with a designedly low angle of venturi divergence that is fluidly downstream from a venturi throat that is fluidly downstream from a venturi convergence of an internal periphery of the delivery tube; and the mixture entry is fluidly downstream from the venturi throat.

15. A fluid-mixer conduit as described in claim 1 wherein:

the input end of the delivery tube and the output end of the delivery tube are sized, shaped and structured for attachment to a design class of tubular connectors.

16. A fluid-mixer conduit as described in claim 13 wherein:

the input end of the delivery tube and the output end of the delivery tube are sized, shaped and structured for attachment to a design class of tubular connectors.

17. A fluid-mixer conduit as described in claim 14 wherein:

the input end of the delivery tube and the output end of the delivery tube are sized, shaped and structured for attachment to a design class of tubular connectors.

18. A method comprising the following steps for mixing ingredients with a liquid in a tubular fluid conduit:

routing a design portion of fluid flow from the tubular fluid conduit to an input tube at a divergence exit and back into the tubular fluid conduit at a mixture entry that is fluidly downstream from the divergence exit;

placing a flow restriction intermediate the divergence exit and the mixture entry in the tubular fluid conduit;

adding at least one mixture ingredient into the input tube at an ingredient entry in the input tube;

causing a flow of fluid under design pressure through the tubular fluid conduit; and allowing expansion pressure downstream from the flow restriction to draw fluid and mixture ingredient from the input tube into the tubular fluid conduit downstream fluidly from the mixture entry.

19. A method as described in claim 18 wherein the input tube has a regulatable flow-control valve intermediate the divergence exit and the mixture entry and comprising an additional step of regulating flow of fluid through the input tube in desired proportion to flow of fluid through the tubular fluid conduit.

20. A method as described in claim 19 and further comprising the additional step of positioning a pressure-operated check valve fluidly downstream from the mixture entry in the input tube and allowing the pressure-operated check valve to prevent back-flow of fluid from the tubular fluid conduit into the input tube downstream fluidly from the mixture entry.

* * * * *